US007299674B2

(12) United States Patent
Palejwala et al.

(10) Patent No.: US 7,299,674 B2
(45) Date of Patent: Nov. 27, 2007

(54) SWAGING TOOL

(75) Inventors: Kirit M. Palejwala, Rowland Heights, CA (US); Gilad Sassoon, Sherman Oaks, CA (US); Angel Elizarraraz, Los Angeles, CA (US); Jon Schroeder, Silverado, CA (US); Jerrold Lear, Los Angeles, CA (US)

(73) Assignee: Designed Metal Connections, Gardena, CA (US)

( * ) Notice: Subject to any disclaimer, the term of this patent is extended or adjusted under 35 U.S.C. 154(b) by 139 days.

(21) Appl. No.: 11/125,888

(22) Filed: May 9, 2005

(65) Prior Publication Data

US 2006/0248939 A1 Nov. 9, 2006

(51) Int. Cl.
*B21D 39/04* (2006.01)
*B21D 37/20* (2006.01)

(52) U.S. Cl. ..... 72/402; 72/416; 72/453.15; 29/237

(58) Field of Classification Search ..... 72/416, 72/402, 453.16, 453.15; 29/237, 252
See application file for complete search history.

(56) References Cited

U.S. PATENT DOCUMENTS 3,771,343 A 11/1973 Dawson
3,823,597 A 7/1974 Hanback et al.
3,848,451 A 11/1974 Allin
4,047,420 A * 9/1977 Edwards ..... 72/416
5,069,058 A 12/1991 Hyatt
6,619,101 B1 * 9/2003 Faucher et al. ..... 72/456
6,769,283 B2 * 8/2004 Suresh ..... 72/416
6,834,524 B2 * 12/2004 Johnston ..... 72/316

FOREIGN PATENT DOCUMENTS

EP 0 376 136 A2 12/1989
WO PCT/US2006/017953 4/2006

* cited by examiner

*Primary Examiner*—Daniel C Crane
(74) *Attorney, Agent, or Firm*—Hogan & Hartson LLP

(57) ABSTRACT

A swaging tool for swaging fittings and joining separate tubes together. The swaging tool includes a removable head assembly having a head member and a first spring clip adapted to retain a first die to a portion of the head member. The head assembly includes a die block and a second spring clip adapted to retain a second die to a portion of the die block. The swaging tool includes a power unit assembly having a base member adapted to receive the die block and head member of the head assembly. The power unit assembly includes a moveable piston adapted to engage the die block so as to move the second die towards the first die during a swaging operation.

16 Claims, 8 Drawing Sheets

SWAGING TOOL

BACKGROUND OF THE INVENTION

1. Field of the Invention

The present invention relates to swaging devices and, in particular, to a swaging tool for swaging fittings.

2. Description of the Related Art

In hydraulic systems, swaged fittings connect ends of tubes together to form fluid-tight connections between the tubes. Swaged fittings in hydraulic systems of aircraft have been used for many years. During the swaging operation, tubes are inserted into a fitting, such as a cylindrical sleeve, and the fitting is then swaged or compressed radially inwardly by the swaging tool. Annular ridges on the outer surface of the fitting are flattened and transferred to the inner surface of the fitting, and form annular indentations in the tube to securely fasten it to the fitting.

The fittings to be swaged are often in locations that are difficult to reach. As a result, there has existed a need for a swaging tool that is compact enough to gain access to hard-to-reach fittings. Some conventional swaging tools provide a compact structure that supports an upper die held within a yoke and a lower die connected to the tool by a die holder. In some swaging tools, the yoke can be separated from the remainder of the tool for connection to the fitting.

There are numerous problems associated with conventional swaging tools. In some conventional swaging tools, the lower die has a tendency to rotate or wobble during swaging operations. Die rotation or wobble can damage the swaging tool and result in a defectively swaged fitting. Repeated improper use of the swaging tool over time could result in wear-related swaging problems. Thus, conventional swaging tools can become unreliable.

There is a need for a swaging tool that is versatile and compact to handle various swaging operations and that overcomes the drawbacks associated with conventional swaging tools.

SUMMARY OF THE INVENTION

The present invention provides a swaging device or tool for swaging hydraulic fittings and joining separate tubes together. In one embodiment, the swaging device includes a head assembly and a power unit assembly. The head assembly includes a head member and a first spring clip that retains a first die to a portion of the head member. The head assembly further includes a die block and a second spring clip that retains a second die to a portion of the die block. The power unit assembly includes a base member with a mounting portion that receives the die block and head member. The power unit assembly includes a moveable piston that engages the die block to move the second die towards the first die, and to thereby swage fittings and join tubes together.

Another embodiment of the invention is a swaging device having a head member with a first die coupled to a portion thereof, a die block having a second die coupled to a portion thereof, and a power unit assembly having a base member with a mounting portion that receives the die block and head assembly. The power unit assembly includes a moveable piston that engages the die block to move the second die towards the first die. The die block couples to the mounting portion of the base member in only one position, and the head member slidably engages the mounting portion of the base member in only one direction.

Another embodiment of the invention is a swaging device having a head assembly with a head member and a first spring clip that retains a first die to a portion of the head member. The head assembly includes a die block and a second spring clip that retains a second die to a portion of the die block. The swaging device further includes a power unit assembly having a base member with a mounting portion that receives the head assembly. The power unit assembly includes a moveable piston that engages the die block of the head assembly when the head assembly is received by the power unit assembly to move the second die towards the first die. The power unit assembly also includes a sleeve that secures the head assembly to the power unit assembly when the head assembly is received by the power unit assembly.

Another embodiment of the invention is a swaging device having a first and a second die, and a head member having a central portion interposed between first and second side portions. The first side portion includes a leg with a first contour, and the second side portion includes a leg with a second contour that is different from the first contour. A first spring clip retains the first die to a portion of the head member. The swaging device includes a die block and a second spring clip that retains the second die to a portion of the die block. The swaging device includes a power unit assembly having a base member with a mounting portion that receives the die block and head member. The power unit assembly includes a moveable piston that engages the die block to move the second die towards the first die. The mounting portion of the base member includes a first channel having a contour that slidably receives the leg of the first side portion of the head member and a second channel having a contour that slidably receives the leg of the second side portion of the head member.

Another embodiment of the invention is a swaging device having a first die with at least one slot, a head member, and a first spring clip having at least one tab that engages the at least one slot of the upper die to retain the first die to a portion of the head member. The swaging device includes a second die having at least one slot, a die block, and a second spring clip having at least one tab that engages at least one slot of the second die to retain the second die to a portion of the die block. The swaging device includes a power unit assembly having a base member with a mounting portion that receives the die block and head member. The power unit assembly includes a moveable piston that engages the die block to move the second die towards the first die.

These and other embodiments and advantages of the invention will become apparent from the following description and accompanying drawings.

DETAILED DESCRIPTION OF THE INVENTION

Figure 1A:
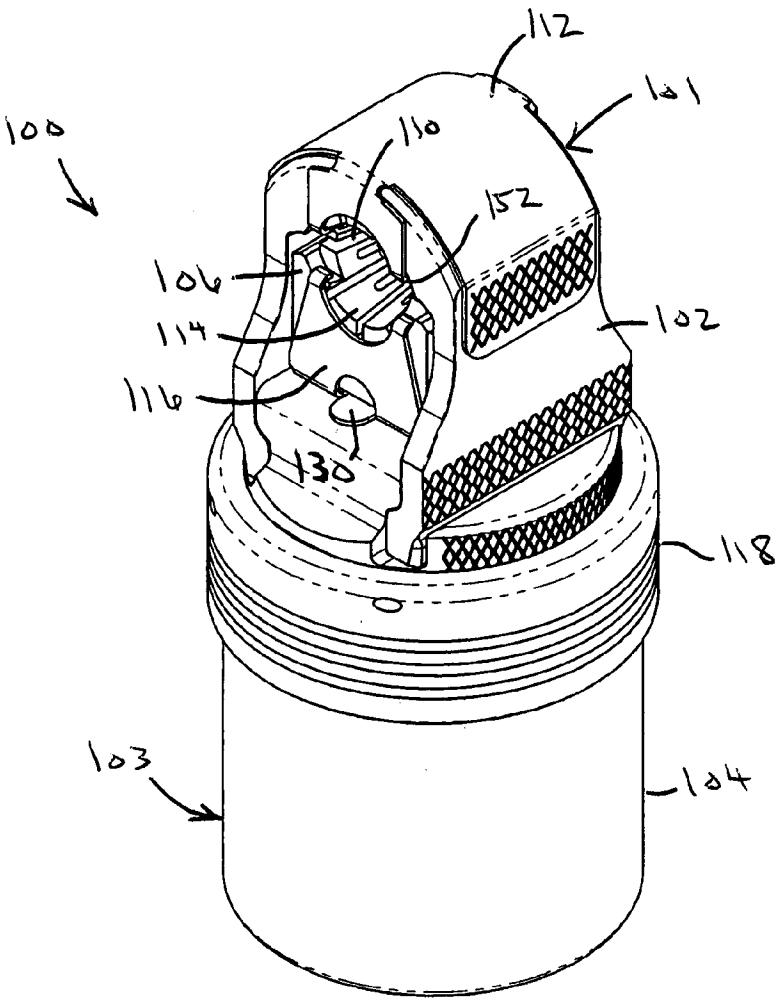
FIG. 1A is a perspective view of a swaging tool having a head or yoke assembly slidably engaged with a power unit assembly according to the present invention.
Figure 1B:
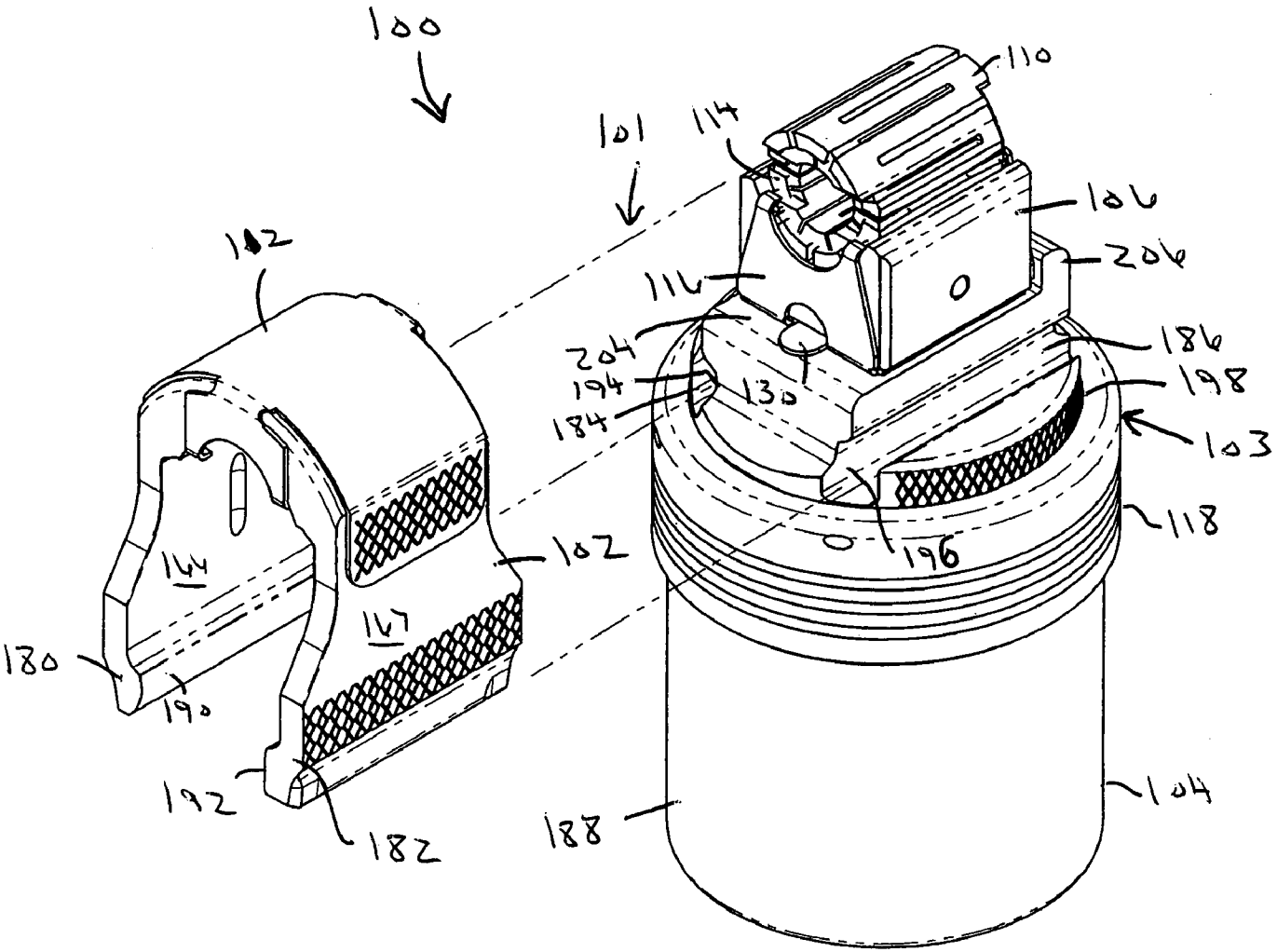
FIG. 1B is a perspective view of the swaging tool of FIG. 1A with the head assembly slidably detached from the power unit assembly.
Figure 1C:
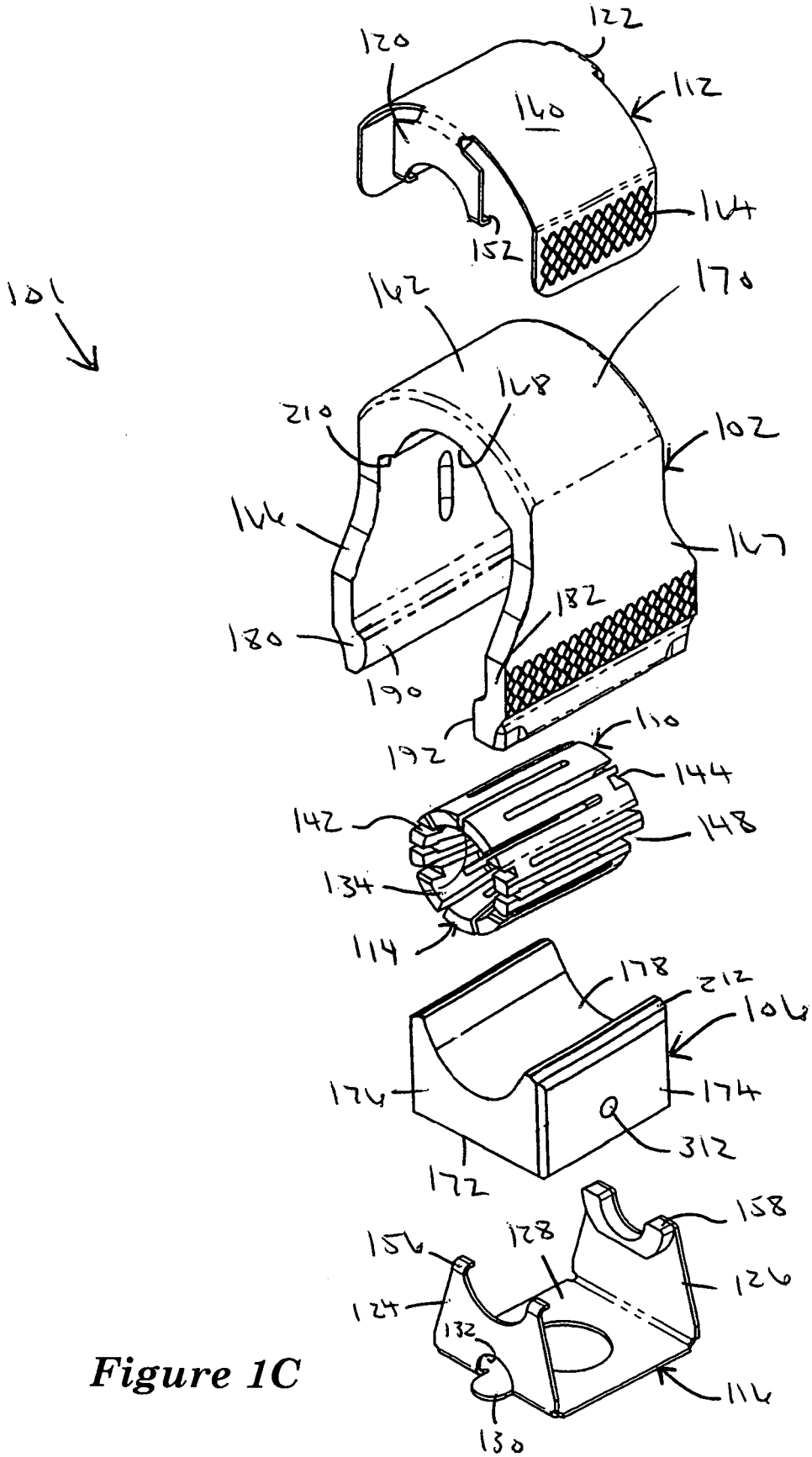
FIG. 1C is an exploded perspective view showing the component parts of the head assembly of FIG. 1A.
Figure 1D:
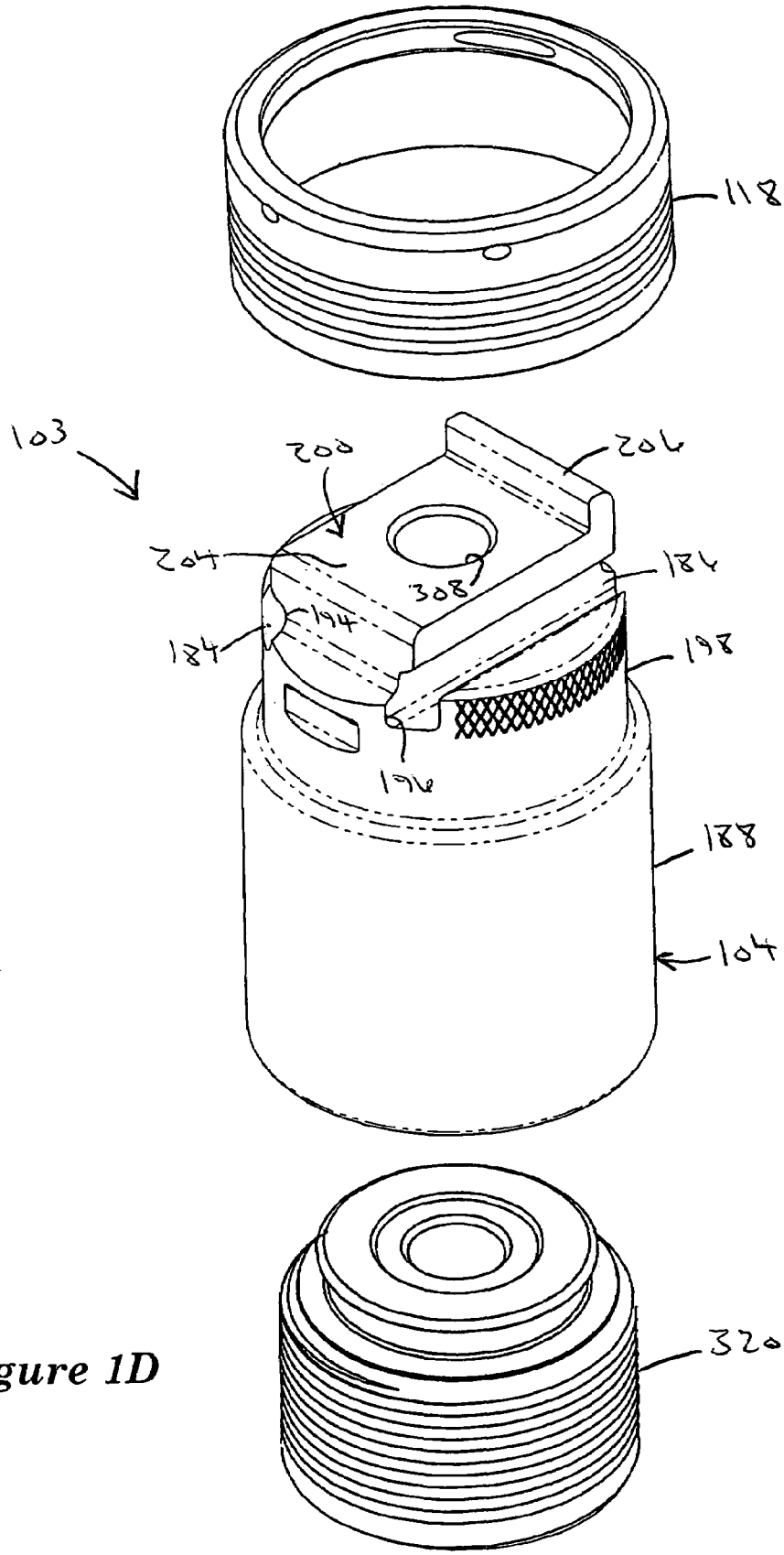
FIG. 1D is an exploded perspective view showing the component parts of the power unit assembly of FIG. 1A.

FIG. 1A depicts an improved swaging tool 100 according to the present invention. Swaging tool 100 has a head or yoke assembly 101 slidably engaged with a power unit assembly 103. FIG. 1B shows swaging tool 100 with a portion of head assembly 101 slidably detached from power unit assembly 103. FIG. 1C shows the component parts of head assembly 101 including head member 102, die block 106, first (upper) and second (lower) dies 110, 114, and first (upper) and second (lower) spring clips 112, 116. FIG. 1D shows the component parts of power unit assembly 103, including base member 104. FIG. 1B shows that die block 106 of head assembly 101 is detachably mounted to an upper portion of base member 104 of power unit assembly 104. First die 110 is detachably mounted to head member 102 of head assembly 101 via first spring clip 112. Second die 114 is detachably mounted to die block 106 via second spring clip 116.

Head member 102 includes a U-shaped structure with a curved central portion 162 integrally formed between at least two side portions 166, 167. Curved central portion 162 includes an outer curved surface 170 that is adapted or contoured to receive an inner curved surface of first spring clip 112. Curved central portion 162 includes an inner curved surface 168 that is adapted or contoured to receive an outer curved surface of first die 110. Head member 102 includes shoulder portions 210 positioned at an inner portion of the intersection point of central portion 162 and side portions 166, 167. Head member 102 includes first and second leg portions 180, 182 formed at lower ends of first and second side portions 166, 167, respectively.

As shown in FIG. 1D, base member 104 of power unit assembly 103 includes a cylindrical lower portion 188 and a cylindrical upper portion 198 having a smaller diameter than lower portion 188. Base member 104 includes a mounting portion 200 having a flat upper surface 204 adjacent to upper portion 198 that is configured to receive die block 106. Mounting portion 200 includes a recess 308 that allows a cylindrical piston rod to pass therethrough and abut die block 106. In one embodiment, recess 308 includes a beveled outer edge.

Mounting portion 200 includes a protruding sidewall 206 that extends from upper surface 204 across the width of mounting portion 200. In one embodiment, as shown in FIG. 1D, mounting portion 200 and protruding sidewall 206 are formed as integral parts of base member 104. Protruding sidewall 206 of mounting portion 200 allows the assembly of die block 106, second die 114, and second spring clip 116 to be positioned on upper surface 204 of mounting portion 200 of base member 104 in only one direction or position and prevents this assembly from being positioned in an improper or wrong direction. This feature is described in greater detail below.

Base member 104 includes first and second channel portions 184, 186 formed on the sides of mounting portion 200 adjacent to upper portion 198 of base member 104. First leg portion 180 is contoured to slidably engage first channel portion 184 of base member 104, and second leg portion 182 is contoured to slidably engage second channel portion 186 of base member 104. Matching first leg portion 180 and corresponding first channel portion 184 along with matching second leg portion 182 and corresponding second channel portion 186 are contoured with different configurations so that head member 102 can engage base member 104 in only one direction. In one embodiment, this non-symmetrical configuration comprises a Murphy Strip configuration to provide a one way engagement between head assembly 101 and power unit assembly 103. If head assembly 101 is rotated relative to power unit assembly 103 such that leg portions 180, 182 of head member 102 do not properly align with corresponding channel portions 184, 186 of base member 104, head assembly 101 will not properly engage power unit assembly 103. That is, leg portion 180 cannot engage channel portion 186 and leg portion 182 cannot engage channel portion 184. In this manner, attachment of head assembly 101 to power unit assembly 103 in a wrong direction is prevented.

In one embodiment, as shown in FIG. 1B, first leg portion 180 has a rounded inner surface 190, while second leg portion 182 has a flat inner surface 192. First channel portion 184 has a rounded inner surface 194 that matches the rounded contour of inner surface 190 of first leg portion 180, while second channel portion 186 has a flat inner surface 196 that matches the flat contour of inner surface 192 of second leg portion 182. These matching configurations of leg portions 180, 182 and corresponding channel portions 184, 186, respectively, allow head member 102 to slidably engage with base member 104 in only one direction. Those of skill in the art will appreciate that alternative non-symmetrical configurations could be used to achieve a one-way sliding engagement between head member 102 and base member 104.

Power unit assembly 103 includes a sleeve or collar member 118 slidably engaged with upper portion 198 of base member 104. In one embodiment, sleeve member 118 is an annular ring having an inner surface that is adapted to engage the outer surface of cylindrical upper portion 198 so as to lock head member 102 in position to base member 104. After head member leg portions 180, 182 slidably engage base member channel portions 184, 186, sleeve member 118 is moved upwards towards head member 102 to secure or lock leg portions 180, 182 within channel portions 184, 186.

Figure 3A:
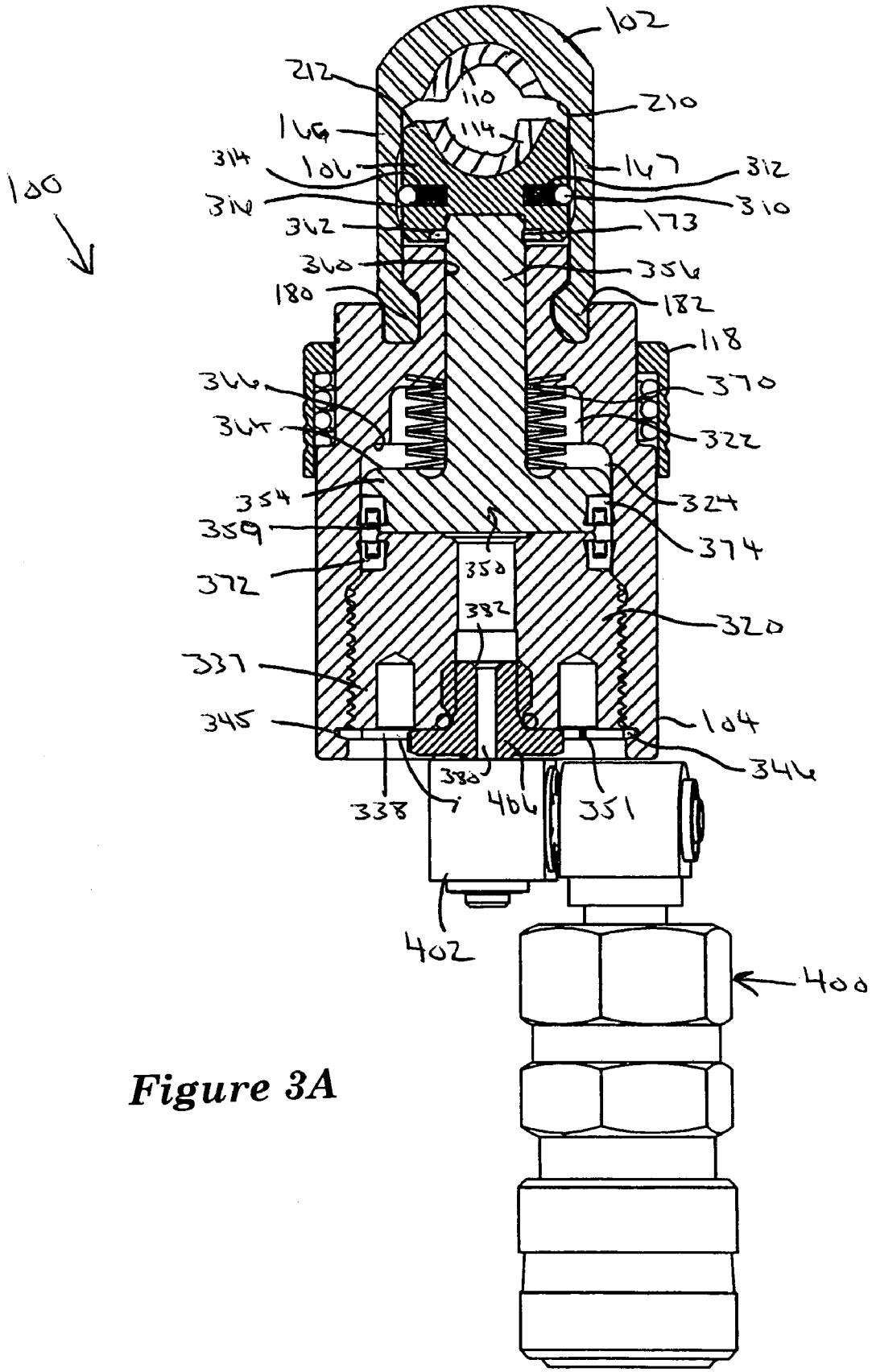
FIG. 3A is a sectional view of the swaging tool of FIG. 1A
Figure 3B:
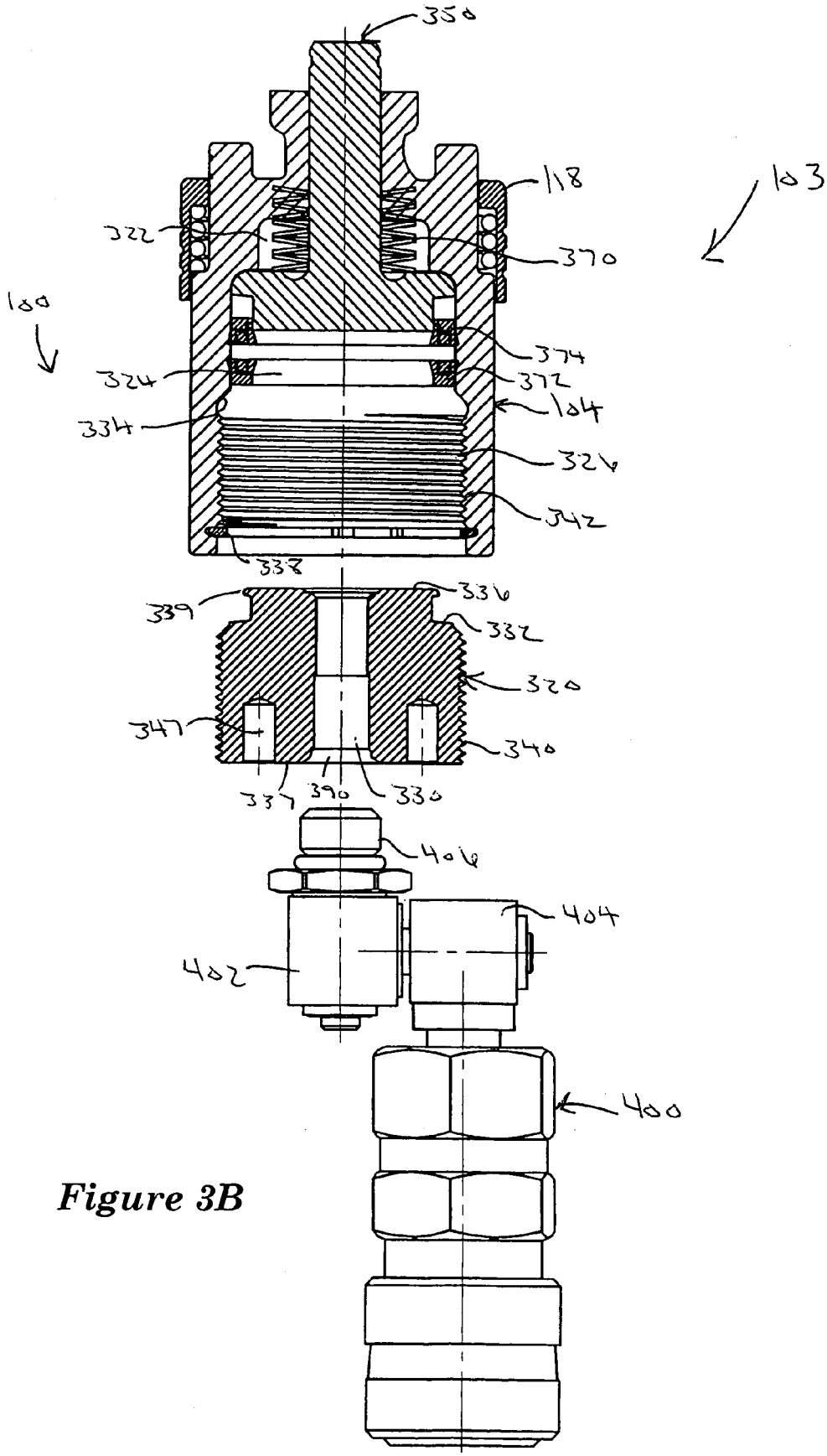
FIG. 3B is an exploded sectional view of the swaging tool of FIG. 1A.

When in a secure or locked position, sleeve member 118 prevents head member 102 from being removed from base member 104 during swaging operations. Thus, sleeve 118 provides a positive fixed position to properly locate head assembly 101 during swaging, and prevents head assembly 101 from falling off if tool 100 is held at an angle other than vertical. Sleeve 118 acts as a guiding mechanism and eliminates the potential for head member 102 to be inadvertently offset (out of position) during swaging, which could induce an overstressed condition to elements of the swage tool components. Sleeve 118 also provides a means in which both the upper and lower dies are maintained in proper alignment with each other, to assure the fitting is swaged properly. As shown in FIGS. 3A-B, a spring may be provided within sleeve 118 to maintain or bias the sleeve in an extended position while head assembly 101 is engaged in a proper position with respect to the power unit. In one embodiment, sleeve member 118 retains head assembly 101 to power unit assembly 103 by use of a guiding mechanism.

As described above, a head alignment means is provided to align head assembly 101 with respect to power unit assembly 103, so that head member 102 properly engages and is secured to base member 104 before operation of swaging tool 100. This, in turn, assures proper alignment of first and second dies 110, 114 and thereby prevents incomplete or improper swaging which might occur if first die 110 is positioned in a reverse orientation with respect to second die 114.

As best shown in FIG. 1C, die block 106 of head assembly 101 includes a lower surface 172, rectangular side surfaces 174, and side surfaces 176 with a curved recess 178 formed therebetween across an upper portion of die block 106. Curved recess 178 is adapted or contoured to receive second die 114. Die block 106 includes shoulder regions 212 that are contoured to engage shoulder portions 210 of head member 102 during movement of lower die block 114 towards head member 102.

Figure 1E:
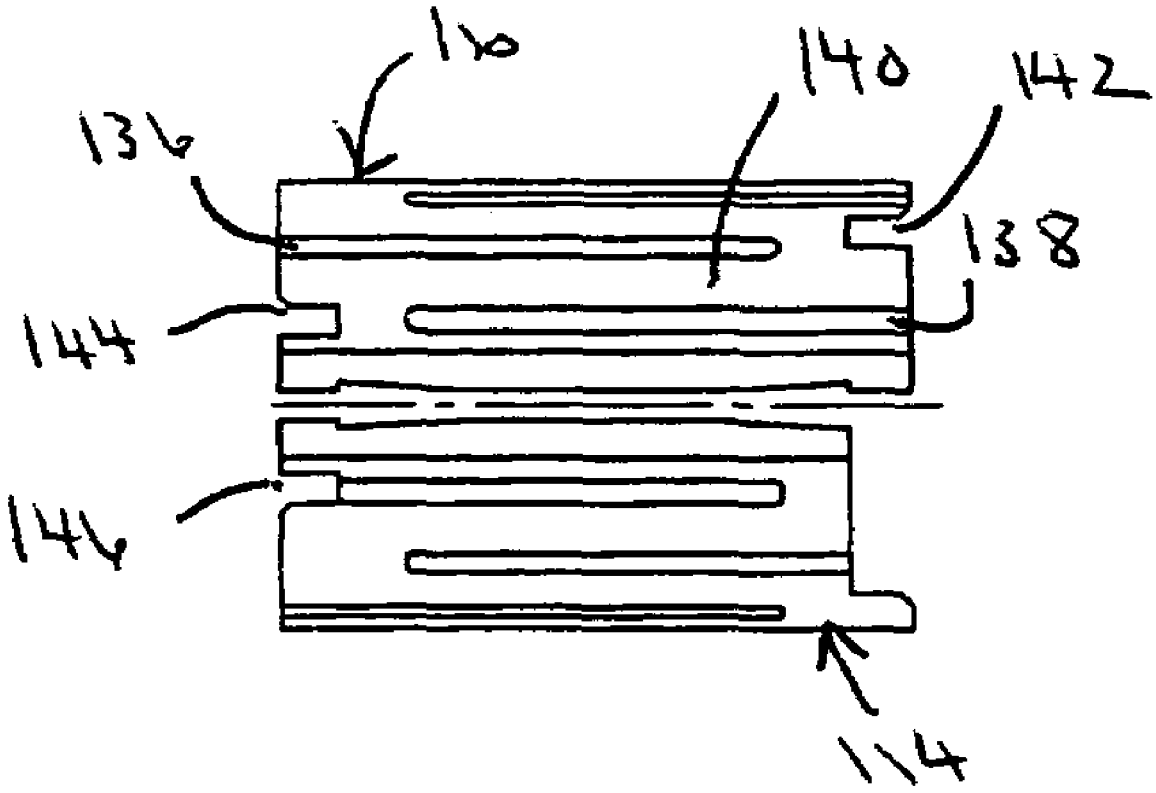
FIG. 1E is an exploded side view of first and second dies of the head assembly of FIG. 1C.

As best shown in FIG. 1E, first and second dies 110, 114 have opposing semi-circular configurations with inner curved surfaces 134 for receiving and swaging an exterior curved surface of a fitting. A plurality of parallel longitudinal slotted channels 136 extend from a left end to a location adjacent a right end of dies 110, 114. Interspersed in alternating fashion with channels 136 are a plurality of parallel longitudinal slotted channels 138 that extend from the right end to a location adjacent the left end of the dies. Slotted channels 136, 138 provide elongated bendable elements 140 that facilitate inward radial compression of dies 110, 114 Upper die 110 includes retention slots 142, 144 for engagement with upper spring clip 112, and lower die 114 includes retention slots 146 for engagement with lower spring clip 116.

First spring clip 112 includes curved portion 160 that is adapted to be positioned adjacent curved portion 162 of head member 102. First spring clip 112 includes side portions 164 that extend downward from end portions of the curved portion 160 thereof and extend over side portions 166, 167 of head member 102. First spring clip 112 includes flange portions 120, 122 that extend downward from a central portion of curved portion 160. Each flange portion 120, 122 includes tabs 152 that protrude inward to the inner portion of first spring clip 112 for secure spring clip retention of first die 110.

First die 110 includes a plurality of upper die retention slots 142, 144 formed adjacent to outer end portions of the first die 110. Upper die retention slots 142, 144 are adapted to receive tabs 152 of first spring clip 112 so as to engage therewith and form a secure attachment thereto. Retention slots 142, 144 allow first die 110 to be machined faster so as to reduce manufacturing and production costs. As shown in FIG. 1A, tabs 152 engage upper die retention slots 142, 144 with curved portion 162 of head member 102 interposed therebetween. Flange portions 120, 122 of first spring clip 112 are biased inward so as to hold first die 110 in position between flange portions 120, 122. Side portions 164 of first spring clip 112 are biased inward so as to hold first spring clip 112 in position adjacent side portions 166, 167 of head member 102. First spring clip 112 allows first die 110 to be mounted to head member 102 without use of fastening screws, thereby avoiding the need to drill apertures into head member 102 in order to mount first die 110 to head member 102.

Second spring clip 116 includes base portion 128 and side portions 124, 126 that upwardly extend therefrom to form an interior portion that is adapted to receive die block 106. Side portions 124, 126 of second spring clip 116 include tabs 156 and an elongated tab 158, respectively, that protrude inwardly to secure second die 114. Second spring clip 116 includes a tab 130 that extends from base portion 128 through aperture 132 adjacent side portion 124. Tab 130 allows the assembly of die block 106, second die 114, and second spring clip 116 to be positioned on mounting portion 200 of base member 104 in only one direction with respect to sidewall 206. Tab 130 interferes with sidewall 206 to prevent the assembly from being positioned on base member mounting portion 200 in an improper direction. For example, if the assembly of die block 106, second die 114, and second spring clip 116 was reversed, tab 130 would contact protruding sidewall 206 and would not allow this assembly to seat properly on mounting portion 200.

Second die 114 includes a plurality of lower die retention slots 146 formed adjacent to one end portion thereof and a lower die retention recess 148 formed adjacent to the other outer end portion thereof. Lower die retention slots 146 receive and engage tabs 156 of second spring clip 116 and forms a secure attachment thereto. Retention slots 146 allow second die 114 to be machined faster so as to reduce manufacturing and production costs. Lower die retention recess 148 receives and engages elongated tab 158 of lower spring clip 116 and forms a secure attachment thereto.

As described above, a lower die alignment means is provided for aligning the assembly of die block 106, second die 114, and second spring clip 116 with respect to base member 104 in a proper orientation prior to performing a swaging operation with swaging tool 100. Proper orientation of this assembly with respect to base member 104 provides proper orientation of second die 114 with respect to first die 110 to ensure proper swaging of a fitting with swaging tool 100. Mounting portion sidewall 206 and spring clip tab 130 allows this assembly to be seated on base member 104 in a preferred configuration and prevents this assembly from being seated on base member 104 in a wrong direction. Sidewall 206 and tab 130 also prevent undesirable wobble or rotation of this assembly with respect to base member 104 during swaging operations, thereby improving reliability and increasing the life of swaging tool 100.

Figure 2:
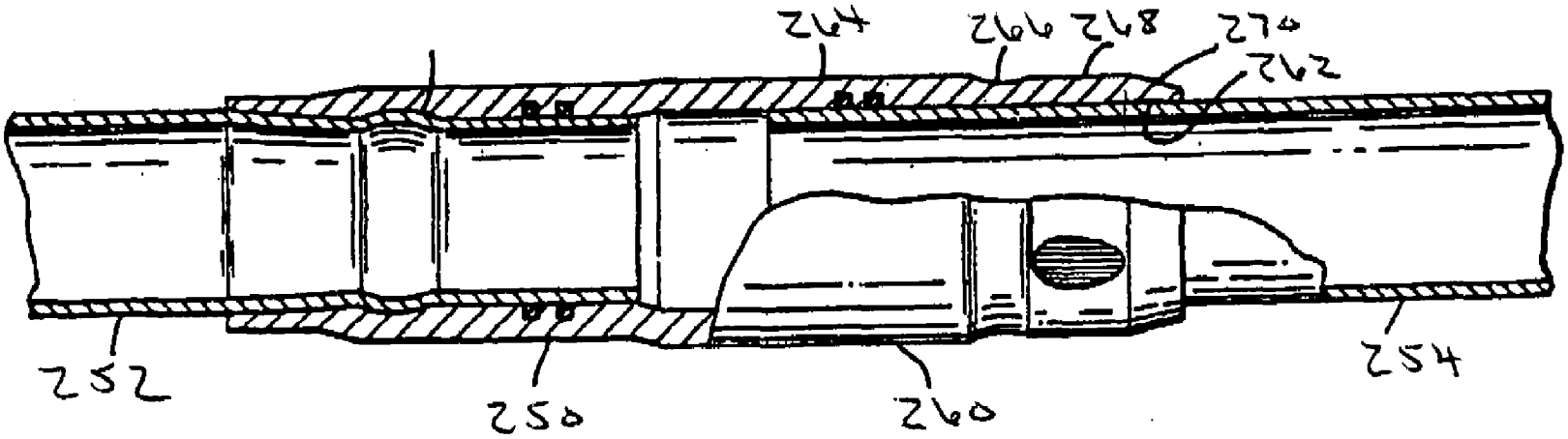
FIG. 2 is a sectional and partial side view of a swaged fitting and two tubes joined together via the improved swaging tool of FIG. 1A.

FIG. 2 illustrates a swaged fitting 250 and two tubes 252, 254 joined together via swaging tool 100. Second die 114 is adapted to move toward first die 110 to swage fitting 250 and join tubes 252, 254 together. As shown in FIG. 2, fitting 250 includes a sleeve 260 for receiving ends of tubes 252, 254. Before swaging, fitting 250 has a smooth, cylindrical inner wall 262 and an irregularly shaped outer wall 264 having an annular groove 266 of reduced diameter adjacent to each end of fitting 250. Extending outwardly from groove 266 are a flat annular ridge 268 and an inwardly tapering nose 270 that extends to the end of fitting 250. The flat surface of ridge 268 is configured to inhibit relative rotation of tube 254 and fitting 250 after swaging has been completed.

During swaging, fitting 250 is compressed inwardly by dies 110, 114 so that fitting 250 forms an irregular contour along inner wall 262 and grips tube 254 tightly. Also, annular ridge 268 of fitting 250 is compressed inwardly to form an annular indentation on inner wall 262 of fitting 250. Tube 252 is correspondingly swaged to a configuration matching the inner wall 262 of fitting 250. Thus, swaging tool 100 provides a permanent leak-proof coupling of two tubes 252, 254.

FIG. 3A illustrates a cross-sectional view of swaging tool 100. FIG. 3B illustrates an exploded cross-sectional view of swaging tool 100.

As shown in FIG. 3A, first die 110 is received within the inner portion of U-shaped head member 102. Shoulder portions 210 of head member 102 are adapted to engage shoulder regions 212 on die block 106 during a swaging operation. The surfaces of shoulder portions 210 and shoulder regions 212 may be tapered with an angle with respect to the transverse axis of swaging tool 100 of, for example, approximately 30°. Tapered surfaces provide uniform stress distribution and less likelihood of tool fractures at these areas of tool 100 and reduce the need to reinforce tool 100 at these areas.

Side portions 166, 167 of head member 102 extend downward in a parallel manner. Side portions 166, 167 have substantially flat and parallel inner and outer surfaces which terminate at inwardly extending leg portions 180, 182. As previously described, leg portions 180, 182 are contoured to slidably engage channel portions 184, 186 to couple head member 102 with base member 104. Channel portions 184, 186 transverse the longitudinal axis of upper cylindrical portion 198 of base member 104. To mount head member 102 to base member 104, leg portion 180, 182 are inserted with a sliding motion into t channel portions 184, 186 until first die 110 is aligned directly over second die 114.

The sliding engagement of leg portions 180, 182 and channel portions 184, 186 enables a direct connection of head member 102 to base member 104 and reduces the need for posts, nuts, or various other fastening components to make or engage the connection. This sliding engagement results in a more reliable swaging tool since a secure connection between head member 102 and base member 104 can be achieved rapidly. Moreover, this sliding engagement reduces wobble and rotation of first die 110 with respect to second die 114 so as to improve performance and reliability of swaging tool 100.

When mounted to base member 104, die block 106 is positioned between side portions 166, 167 of head member 102. Die block 106 is retained between side portions 166, 167 by ball 310 that is positioned within opening 312 in die block 106 and is biased outwardly by spring 314 into groove 316 of side portions 166, 167. Groove 316 extends in an axial direction a sufficient distance to allow second die 114 and die block 106 to move toward first die 110 during swaging while head member 102 and first die 110 remain stationary. Lower surface 172 of die block 106 abuts upper surface 204 of mounting portion 200 of base member 104.

As shown in FIGS. 3A, 3B, base member 104 of power unit assembly 103 includes an inner cylindrical portion that is divided into first, second, and third cylinder chambers 322, 324, 326. Power unit assembly 103 includes a single piston 350, a removable end cap 320, and a snap ring 338 positioned within the inner cylindrical portion of base member 104. As will be described in greater detail herein below, snap ring 338 provides retention of end cap 320 within base member 104 of power unit assembly 103. During swaging of a fitting, such as fitting 250 of FIG. 2, second die 114 is moved toward first die 110 by piston 350 within cylindrical base member 104 of power unit assembly 103.

As shown in FIGS. 3A, 3B, end cap 320 is threaded into position within third chamber 326 of base member 104. In one embodiment, end cap 320 comprises a cylindrical structure having a central axial aperture 330 positioned between head and base portions 336, 337 thereof. Head portion 336 has a cylindrical diameter less than that of the cylindrical diameter of base portion 337. End cap 320 includes a first seal member 372 having a ring-shaped structure that is adapted to couple with head portion 336. End cap 320 includes a lip portion 339 that extends outwardly from head portion 336 to trap first seal member 372 against head portion 336 and between lip portion 339 and base portion 337. First seal member 372 provides a fluid barrier between end cap 320 and base member 104.

The outer circumferential edges of end cap 320 include outwardly extending annular shoulder 332, which is positioned against an inwardly extending annular shoulder 334 on the inner surface of base member 104. End cap 320 includes an externally threaded outer surface 340 to engage internally threaded surface 342 of third chamber 326. Upon threaded engagement of end cap 320 into third chamber 326, shoulder 332 of end cap 320 abuts shoulder 334 of base member 104.

As shown in FIG. 3A, end cap 320 is secured or retained within lower chamber 324 of base member 104 via snap ring 338. In one embodiment, snap ring 338 comprises a cylindrical disk having a central axial aperture and a beveled outer circumferential edge 346 that snaps into recessed channel 345 on the inner surface of base member 104. When snap ring 338 is fully snapped into channel 345, end cap 320 is trapped between the lower open end of base member 104 and shoulder 334 on the inner surface of base member 104. Central axial aperture 330 of end cap 320 and the central axial aperture of snap ring 338 are aligned and permit introduction of fluid to the inner portion of base member 104 so as to allow pneumatic or hydraulic operation of swaging tool 100. It should be appreciated that central axial aperture 330 of end cap 320 comprises a smooth inner cylindrical surface.

Base portion 337 of end cap 320 includes mounting apertures 347 that are adapted to receive fasteners, such as screws, for securing snap ring 338 to end cap 320. When end cap 320 is threaded into position within base member 104 and snap ring 338 is positioned in recessed channel 345, fasteners may be inserted through apertures 351 formed in snap ring 338 and into mounting apertures 347 to secure snap ring 338 to end cap 320. This prevents end cap 320 from backing out of base member 104 during a swaging operation.

End cap 320 includes a pressure inlet port 390 formed in base portion 337. In one embodiment, pressure inlet port 390 of end cap 320 comprises a high pressure inlet port, such as, for example an MS port configuration with MS33649-2 threads, that facilitates mounting of a two-axis swivel 400 via an adapter 406 to power unit assembly 103. The high pressure inlet port configuration of pressure inlet port 390 reduces the stress of introducing pressurized fluid into power unit assembly 103 during a swaging operation. Swivel 400 includes first swivel joint 402 that allows swaging tool 100 to rotate in a plane that coincides with an axis of base member 104. As shown in FIG. 3A, first swivel joint 402 of swivel 400 couples with end cap 320 via adapter 406. Swivel 400 includes a second swivel joint 404 that allows swaging tool 100 to follow a cylindrical path around a longitudinal axis of swivel 400. Swivel 400 allows swaging tool 100 to be directed in substantially any direction. This feature has important utility when performing swaging operations in confined spaces or when direct axial access to a fitting, such as fitting 250, is restricted by the surrounding environment.

In one embodiment, externally threaded outer surface 340 of end cap 320 comprises tapered threads. In general, tapering the thread of either a male or female threaded component in a proper fashion improves thread load distribution as compared to conventional constant-pitch threads. Thus, tapered threads on outer surface 340 of end cap 320 may improve the strength of the threaded connection between end cap 320 and internally threaded surface 342 of base member 104. Threads 340 may be tapered outwardly such that the outer diameter of end cap 320 increases from upper portion 336 in a direction towards lower portion 337, while internal threads 342 of base member 104 are formed, for example, in a conventional constant-pitch manner.

Piston 350 of power unit assembly 103 includes a base portion 354 reciprocally retained within second chamber 324, a rod portion 356 extending through first chamber 322 and through an axial aperture 360 in upper portion 198 of base member 104, rod portion 356 having an upper head portion that abuts and engages die block 106 via retaining ring 362. In one embodiment, retaining ring 362 is formed of a Teflon material, but may comprise other materials without departing from the scope of the invention. The upper head portion of rod 356 includes a counter groove 173 that is received within recess 308 in mounting portion 200 of base member 104 and is secured to die block 106 with retaining ring 362. When head assembly 101 and power unit assembly 103 are coupled, retaining ring 362 retains die block 106 to piston 350 so that second die 114 remains aligned with first die 110 during movement of piston 350 in a swaging operation. Swaging tool 100 utilizes a single piston 350, which is an improvement over prior art swaging tools.

Annular shoulder 364 formed at the top of piston base portion 354 engages inwardly extending annular shoulder 366 on the inner surface of base member 104. Annular shoulder 366 functions as an internal stop to limit movement of piston 350 during swaging. During swaging, second die 114 is moved toward first die 110 by die block 106 and piston 350 within base member 104. Upon engagement, annular shoulder 366 of base member 104 abuts annular shoulder 364 of piston 350.

The lower portion of piston base portion 354 includes second seal member 374 that provides a fluid barrier between piston 350 and base member 104. Second seal member 374 is a ring-shaped structure that couples with piston base portion 354. Piston 350 includes a lip portion 359 that extends outwardly from the lower end of base portion 354 to trap second seal member 374 between lip portion 359 and base portion 354.

As previously discussed, first seal member 372 engages end cap 320 to provide a fluid barrier between end cap 320 and base member 104. First and second seal members 372, 374 trap fluid introduced into second chamber 324 of base member 104 between base portion 354 of piston 350 and head portion 336 of end cap 320.

Power unit assembly 103 includes one or more return springs 370 that are positioned in first chamber 322 around piston rod portion 356 and above piston base portion 354. Spring 370 biases piston 350 against end cap 320 in the absence of fluid pressure in base member 104. After swaging is complete, piston 350 retracts against end cap 320 due to the biasing effect of return spring 370. Conversely, the engagement of annular shoulders 364, 366 within base member 104 during swaging provides an internal stop to prevent over-compression and fatigue of return spring 370. These limits to movement of piston 350 results in a more reliable operation and performance of swaging tool 100.

In one embodiment, return spring 370 includes one or more disc springs that carry the same load in much less space than a significantly larger helical spring. A stack of disc springs is smaller in diameter, lighter in weight, carries larger loads, and provides faster return of piston 350 than a conventional helical spring. This features contributes to a reduced size and weight of swaging tool 100.

Some components of swaging tool 100, including head member 102, base member 104, die block 106, first die 110, second die 114, end cap 320, snap ring 338, and piston 350, are preferably formed from high tensile strength materials. Other components may be formed or constructed from cold rolled steel or free machined steel. Return spring 370 may be formed of spring steel.

An axial passageway 380 extending through adapter 406 permits fluid communication with piston 350. Fluid from passageway 380 enters end cap 320 through axial aperture 330 and snap ring 338 to push piston 350, die block 106, and second die 114 towards first die 110. Passageway 380 may include a beveled edge 382 to facilitate introduction of fluid into central axial aperture 330. As fluid reaches piston 350 via passageway 380, the fluid moves piston 350, which in turn moves die block 106 and second die 114 towards first die 110. Fluid is then dispersed rapidly behind base portion 354 of piston 350. This configuration utilizes the surface area of piston base portion 354 to provide substantial force for movement of piston 350 against upper die block 106. Thus, piston force is increased without increased fluid pressure. A smaller sized piston arrangement may be utilized, which results in a more compact and lighter swaging tool.

Operation of the swaging tool 100 is as follows. A fitting 250 is positioned between first and second dies 110, 114. This is accomplished by removing head assembly 101 from power unit assembly 103, positioning fitting 250 in the curved region of second die 114, and then replacing head assembly 101 on power unit assembly 103 so that fitting 250 is positioned between first and second dies 110, 114. Sleeve member 118 is then moved into lock position to lock leg portions 180, 182 within channel portions 184, 186 of base member 104.

After fitting 250 is properly positioned and sleeve member 118 secured, pressurized fluid is admitted into base member 104 through end cap 320 and snap ring 338. The pressurized fluid forces piston 350 against die block 106 to move second die 114 toward first die 110. Compression of dies 110, 114 continues until shoulder 210 of head member 102 abuts shoulder 212 of die block 106. After fluid pressure is released and spring 370 returns piston 350 to a retracted position, swaging is complete and fitting 250 may be removed from tool 100.

In some instances, the assembled swaging tool 100 may be inserted directly onto a fitting, such as fitting 250, if one of tubes 252, 254 to be swaged has a free end to permit access in this manner. In other circumstances, it may be necessary to remove head assembly 101 from power unit assembly 103 to position head assembly 101 around the fitting between the free ends of the side portions 166, 167 or leg portions 180, 182. In the latter situation, the sliding engagement of head assembly 101 and power unit assembly 103 permits rapid assembly of swaging tool 100 and is especially useful in swaging fittings in difficult-to-access locations, such as overhead or in confined spaces. After swaging of the fitting, head assembly 101 may be rapidly removed from power unit assembly 103 to swage a next fitting.

From the foregoing, it will be appreciated that improved swaging tool 100 is adapted to swage fittings, such as fitting 250 for connecting tubes 252, 254, especially fittings located in difficult-to-access areas. Tool 100 provides effective means for ensuring proper connection, alignment, and orientation of first die 110 with respect to second die 114, and various improved features over known swaging tools to contribute to a more reliable swaging tool than heretofore developed.

Although preferred embodiments of the invention have been shown and described, it will be understood that modification may be made by those skilled in the art without departing from the spirit and scope of the invention, as defined by the appended claims.

The invention claimed is:

1. A swaging device comprising:

a first and second die;

a head member;

a first spring clip adapted to retain the first die to a portion of the head member;

a die block;

a second spring clip adapted to retain the second die to a portion of the die block; and a power unit assembly having a base member with a mounting portion adapted to receive the die block and head member, the power unit assembly having a moveable piston adapted to engage the die block so as to move the second die towards the first die, wherein the base member includes a protruding sidewall that extends from the mounting portion of the base member, and wherein the spring clip includes a tab that extends from a portion thereof so as to allow the die block to be positioned on the mounting portion of the base member in only one direction or position.

2. The device of claim 1, wherein the power unit assembly includes at least one spring that is positioned between the piston and mounting portion of the base member, wherein the piston is adapted to move within the base member between a retracted position such that the at least one spring biases the piston away from the mounting portion of the base member and a stop position such that the at least one spring is compressed when the piston is moved towards the mounting portion of the base member.

3. The device of claim 1, wherein the base member of the power unit assembly includes a first shoulder that stops the piston from moving towards the mounting portion of the base member.

4. The device of claim 1, wherein the base member includes a threaded aperture and a second shoulder, and wherein the power unit assembly includes an end cap having a threaded outer surface that is adapted to engage the threaded aperture of the base member so as to position the end cap within the base member adjacent the second shoulder.

5. The device of claim 4, wherein the base member includes at least one recessed channel adjacent to the threaded aperture, and wherein the power unit assembly includes a snap ring that engages with the recessed channel of the base member so as to secure the end cap within the base member.

6. The device of claim 1, wherein the head member slidably engages the mounting portion of the base member in a single direction.

7. The device of claim 1, wherein the head member includes a central portion interposed between a first side portion having a leg with a first contour and a second side portion having a leg with a second contour that is different than the first contour.

8. The device of claim 7, wherein the mounting portion of the base member includes a first channel having a contour that is adapted to slidably receive the leg of the first side portion and a second channel having a contour that is adapted to slidably receive the leg of the second side portion.

9. The device of claim 1, further comprising a sleeve that is adapted to secure the head member to the base member when the head member is received by the mounting portion of the base member.

10. The device of claim 1, wherein the die block includes an aperture that is adapted to receive a portion of the piston, and wherein the die block includes a retaining ring that secures a portion of the piston to the die block.

11. The device of claim 1, further comprising first and second seals, wherein the first seal is adapted to be attached to a portion of the end cap so as to provide a fluid barrier between the end cap and the base member of the of the power unit assembly, and wherein the second seal is adapted to be attached to a portion of the piston so as to provide a fluid barrier between the piston and the base member of the power unit assembly.

12. The device of claim 1, wherein the end cap includes a high pressure inlet port.

13. A swaging device comprising:

a first and second die;

a head member;

a first spring clip adapted to retain the first die to a portion of the head member;

a die block;

a second spring clip adapted to retain the second die to a portion of the die block; and a power unit assembly having a base member with a mounting portion adapted to receive the die block and head member, the power unit assembly having a moveable piston adapted to engage the die block so as to move the second die towards the first die, wherein the first die includes at least one slot having opposed sides, and wherein the first spring clip includes at least one tab that is adapted to engage the at least one slot of the first die so as to retain the first die to the head member in a position such that the head member is interposed between the first die and the first spring clip.

14. A swaging device comprising:

a first and second die;

a head member;

a first spring clip adapted to retain the first die to a portion of the head member;

a die block;

a second spring clip adapted to retain the second die to a portion of the die block; and a power unit assembly having a base member with a mounting portion adapted to receive the die block and head member, the power unit assembly having a moveable piston adapted to engage the die block so as to move the second die towards the first die, wherein the second die includes at least one slot having opposed sides, and wherein the second spring clip includes at least one tab that is adapted to engage the at least one slot of the second die so as to retain the second die to the die block in a position such that the die block is interposed between the second die and the second spring clip.

15. A swaging device comprising:

a head member having a first die coupled to a portion thereof;

a die block having a second die coupled to a portion thereof; and a power unit assembly having a base member with a mounting portion adapted to receive the die block and head member and having a protruding sidewall extending therefrom, the power unit assembly having a moveable piston adapted to engage the die block so as to move the second die towards the first die, wherein the protruding sidewall allows assembly of the die block to the mounting portion of the base member in only one position; and wherein the head member slidably engages the mounting portion of the base member in only one direction.

16. A swaging device comprising:

a first die having at least one slot having opposed sides;

a head member;

a first spring clip having at least one tab that is adapted to engage the at least one slot of the first die so as to retain the first die to a portion of the head member;

a second die having at least one slot having opposed sides;

a die block;

a second spring clip having at least one tab that is adapted to engage the at Least one slot of the second die so as to retain the second die to a portion of the die block; and a power unit assembly having a base member with a mounting portion adapted to receive the die block and head member, the power unit assembly having a moveable piston adapted to engage the die block so as to move the second die towards the first die.

* * * * *